US012478861B2

(12) United States Patent
Kang et al.

(10) Patent No.: US 12,478,861 B2
(45) Date of Patent: Nov. 25, 2025

(54) BALL THROWING GAME MACHINE

(71) Applicant: KOMUSE Co., Ltd., Paju-si (KR)

(72) Inventors: Nam Ho Kang, Gimpo-si (KR); Ryeol Baek, Goyang-si (KR)

(73) Assignee: KOMUSE Co., Ltd., Paju-si (KR)

( * ) Notice: Subject to any disclaimer, the term of this patent is extended or adjusted under 35 U.S.C. 154(b) by 742 days.

(21) Appl. No.: 17/945,131

(22) Filed: Sep. 15, 2022

(65) Prior Publication Data

US 2024/0050842 A1 Feb. 15, 2024

(30) Foreign Application Priority Data

Aug. 11, 2022 (KR) ..... 10-2022-0100610

(51) Int. Cl.
*A63F 7/02* (2006.01)
*A63F 7/38* (2006.01)

(52) U.S. Cl.
CPC ..... *A63F 7/02* (2013.01); *A63F 7/38* (2013.01); *A63F 2300/61* (2013.01); *A63F 2300/8011* (2013.01)

(58) Field of Classification Search
CPC ..... A63F 7/02; A63F 7/38; A63F 2300/61; A63F 2300/8011
See application file for complete search history.

(56) References Cited

U.S. PATENT DOCUMENTS 11,288,930 B1 * 3/2022 Lim ..... A63F 9/0247
2013/0147111 A1 * 6/2013 Popadiuk ..... A63F 7/307 273/118 A

FOREIGN PATENT DOCUMENTS

CN 107866066 A * 4/2018 ..... A63F 7/02
CN 111054051 A * 4/2020 ..... A63F 7/02
DE 202017004518 U1 * 8/2018 ..... A63F 7/307
GB 2621422 A * 2/2024 ..... A63F 7/24
KR 200450824 Y1 11/2010

* cited by examiner

*Primary Examiner* — Raleigh W Chiu
(74) *Attorney, Agent, or Firm* — You & IP, LLC

(57) ABSTRACT

Disclosed is a ball throwing game machine in which, when a ball is hit by a hitting device whose hitting force is controlled by a handle, the ball is thrown to fly toward a game operation part and enters the game operation part, and here, a control device, which has received a light emission color signal and a ball entry signal from the game operation part, outputs a score signal to a score display device that corresponds to the light emission color signal from the game operation part to display a predetermined score on the score display device corresponding to the light emission color signal from the game operation part at the time the ball enters.

7 Claims, 5 Drawing Sheets

BALL THROWING GAME MACHINE

CROSS-REFERENCE TO RELATED APPLICATION

This application claims priority to and the benefit of Korean Patent Application No. 10-2022-0100610, filed on Aug. 11, 2022, the disclosure of which is incorporated herein by reference in its entirety.

BACKGROUND

1. Field of the Invention

The present disclosure relates to a ball throwing game machine, and more particularly, to a ball throwing game machine in which a ball is let to fly toward a game operation part using a hitting device of a main body, the ball flying in the air enters the game operation part configured to slide back and forth and emit light with a time difference so that a color thereof changes to a color corresponding to a color of any one score display device, and a predetermined score is input into the score display device corresponding to the color of light emitted from the game operation part at the time the ball enters.

2. Discussion of Related Art

Generally, when using a ball throwing game machine, a user holding a ball throws the ball into a hole having a predetermined shape and obtains a score according to the number of balls that pass through the hole.

Patent Document 1 discloses a conventional ball throwing game apparatus including a base that sits on the ground, an inclined front plate that is hinge-connected to one end of the base, is formed to be inclined at a predetermined angle, and has a plurality of scoring holes formed in an entire surface thereof, and an inclined rear plate that has an upper end connected to the inclined front plate and a lower end connected to the base to keep the inclined front plate inclined at the predetermined angle.

Here, the base, the inclined front plate, and the inclined rear plate have connecting parts to be hinge-coupled to each other and are carried while being folded onto each other to be flat.

That is, the base, the inclined front plate, and the inclined rear plate are unfolded to form a triangular shape, and in that state, the base is placed on the ground to keep the inclined front plate and the inclined rear plate inclined downward in directions opposite to each other.

Then, the plurality of scoring holes formed in the entire surface of the inclined front plate are exposed while inclined at the predetermined angle, and here, the user who is at a predetermined distance from the ball throwing game apparatus and holding a ball throws the ball so that the ball enters different scoring holes.

Here, the ball thrown in the air flies in a parabolic or linear trajectory and enters one scoring hole, and according to a score that corresponds to the scoring hole, the user obtains a ball throw score.

In particular, in a case in which the thrown ball collides with the perimeter of the scoring hole or collides with the inclined front plate and bounces off, the number of usable balls is reduced right away.

However, the ball throwing game apparatus according to Patent Document 1 has problems that a level of interest in the game rapidly decreases due to a simple game method in which a score is obtained by throwing a ball into scoring holes that allow different scores to be obtained, there is trouble that a ball should often be recovered from inside the scoring holes during each game at the time of throwing a ball into the scoring holes, there is an inconvenience that a user should directly remember or write down the score that corresponds to the scoring hole the ball enters, and there is difficulty that, at the time a ball enters a scoring hole in which another previously-thrown ball is present, the ball collides with the previously-thrown ball present in the scoring hole and bounces off and falls out of the scoring hole such that it is difficult for a plurality of balls to be thrown into the same scoring hole. In particular, for the elderly or children with low muscular strength, the distance a ball travels after being thrown is relatively short as compared to normal adults, which makes it difficult for the elderly or children to throw a ball into a scoring hole, and thus there is an inconvenience that a distance at which a ball is thrown should be readjusted or a relatively lightweight ball should be used, and as a result, reliability of the ball throwing game apparatus is reduced.

RELATED ART DOCUMENT

Patent Document (Patent Document 1) KR 20-0450824 Y1

SUMMARY OF THE INVENTION

The present disclosure is directed to providing a ball throwing game machine which includes a main body having an inclined plate formed on a bottom surface, a hitting device formed on a front end to hit a ball, and a handle configured to control a hitting force of the hitting device, a plurality of score display devices formed on the inclined plate and having a plurality of different colors, a game operation part configured to slide back and forth on an upper surface of an inner side of the main body and be changed to emit light of a color corresponding to any one score display device, and a control device installed on the inner side of the main body and configured to control the sliding movement of the game operation part and simultaneously receive a ball entry signal and a light emission color signal from the game operation part to output a score signal to any one score display device, wherein, when a ball is hit by the hitting device whose hitting force is controlled by the handle, the ball is thrown to fly toward the game operation part and enters the game operation part, and here, the control device, which has received the light emission color signal and the ball entry signal from the game operation part, outputs a score signal to a score display device that corresponds to the light emission color signal from the game operation part to display a predetermined score on the score display device corresponding to the light emission color signal from the game operation part at the time the ball enters.

In order to achieve the above objective of the present disclosure, a ball throwing game machine according to the present disclosure includes: a main body having an inclined plate formed on a bottom surface and formed to be inclined downward from a rear end toward a front end, a hitting device formed on the front end to receive a ball sliding downward along the inclined plate and configured to hit the ball so that the ball is thrown to fly in air toward the inclined plate, and a handle formed on a front surface and connected to the hitting device to control a hitting force of the hitting device; a plurality of score display devices formed on an upper surface of the inclined plate in a longitudinal direction thereof and formed to be partitioned and spaced at a predetermined interval from each other and have different colors; a game operation part positioned on an upper portion of the inclined plate and installed to slide on an upper surface of an inner side of the main body and configured to slide back and forth and be changed with a time difference to emit light of a color corresponding to any one of the plurality of score display devices to allow the ball flying in the air to enter; and a control device installed on the inner side of the main body and configured to control sliding movement of the game operation part and simultaneously receive a ball entry signal and a light emission color signal, at the time the ball enters, from the game operation part to output a signal to the score display device corresponding to the color of light emitted from the game operation part and input a score to the score display device corresponding to the color of light emitted from the game operation part.

In the ball throwing game machine according to the present disclosure, the main body may be formed so that the handle returns to its original position due to an elastic force, and the hitting device may include a base plate which has a plate shape and is formed so that an upper surface thereof is recessed to form a seating hole that allows the ball to be seated, a ball entry device which is installed to be fixed to an upper surface of the base plate and is configured to move the ball, which has slid downward along the inclined plate, upward to guide the ball to fall into the seating hole, and a hitting link which has one end connected to the handle and the other end rotatably installed on the base plate to hit the ball seated in the seating hole.

In the ball throwing game machine according to the present disclosure, the ball entry device may include: a ball guide part which has a hollow shape, has an upper end formed to be bent toward the seating hole of the base plate and a lower end formed to stand upright, and is configured to guide upward movement of the ball, which has slid downward along the inclined plate, to guide the ball to fall into the seating hole; a blade which is installed on a lower end of the ball guide part and is configured to rotate in-situ and press the ball, which is positioned on the lower end of the ball guide part, upward so that the ball moves upward along the ball guide part; and a driving motor which is positioned directly above the blade, is installed to be fixed to an inner wall surface of the main body, and is connected to the blade via a belt to transmit rotation power to the blade through the belt.

In the ball throwing game machine according to the present disclosure, the main body may further included a missed-ball score display window formed between the score display devices and the hitting device to display a score that corresponds to the number of balls that collide with an edge of the game operation part, then slide downward along the inclined plate and are supplied to the hitting device.

In the ball throwing game machine according to the present disclosure, the game operation part may include: a guide rail which is formed on the upper surface of the main body in the longitudinal direction thereof; a sliding operation part which is coupled to slide on the guide rail and has a lower end moving into the main body and positioned on the upper portion of the inclined plate; and a game board which is installed to be fixed to a lower end of the sliding operation part and has a ball entry hole, which allows entry of a ball, formed in a central portion and a light emitting part formed on an edge of the ball entry hole.

In the ball throwing game machine according to the present disclosure, the ball entry hole may include: a push switch which is formed on an inner wall surface and is pressed by a ball entering the ball entry hole to detect whether the ball has entered; and a ball support part which is installed to horizontally move on the inner wall surface, has an end positioned in the ball entry hole to support the ball entering the ball entry hole, and is configured to receive a signal from the push switch and horizontally move to guide the ball in the ball entry hole to fall and be discharged downward.

In the ball throwing game machine according to the present disclosure, the game board may further include: a score display window which is formed on a front surface and configured to display a sum of scores input to the plurality of score display devices; a bonus score display window which is formed on an upper end of the score display window and configured to display a bonus score; a plurality of number display windows which are partitioned from each other and configured to display the number of remaining balls available for hitting and the number of balls that have entered the ball entry hole; and a notification window which is configured to display the number of balls provided upon a start of a game and the number of balls that should enter the ball entry hole for a bonus mode to begin to obtain the bonus score input to the bonus score display window.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, embodiments of the present disclosure will be described in more detail with reference to the accompanying drawings.

Figure 1:
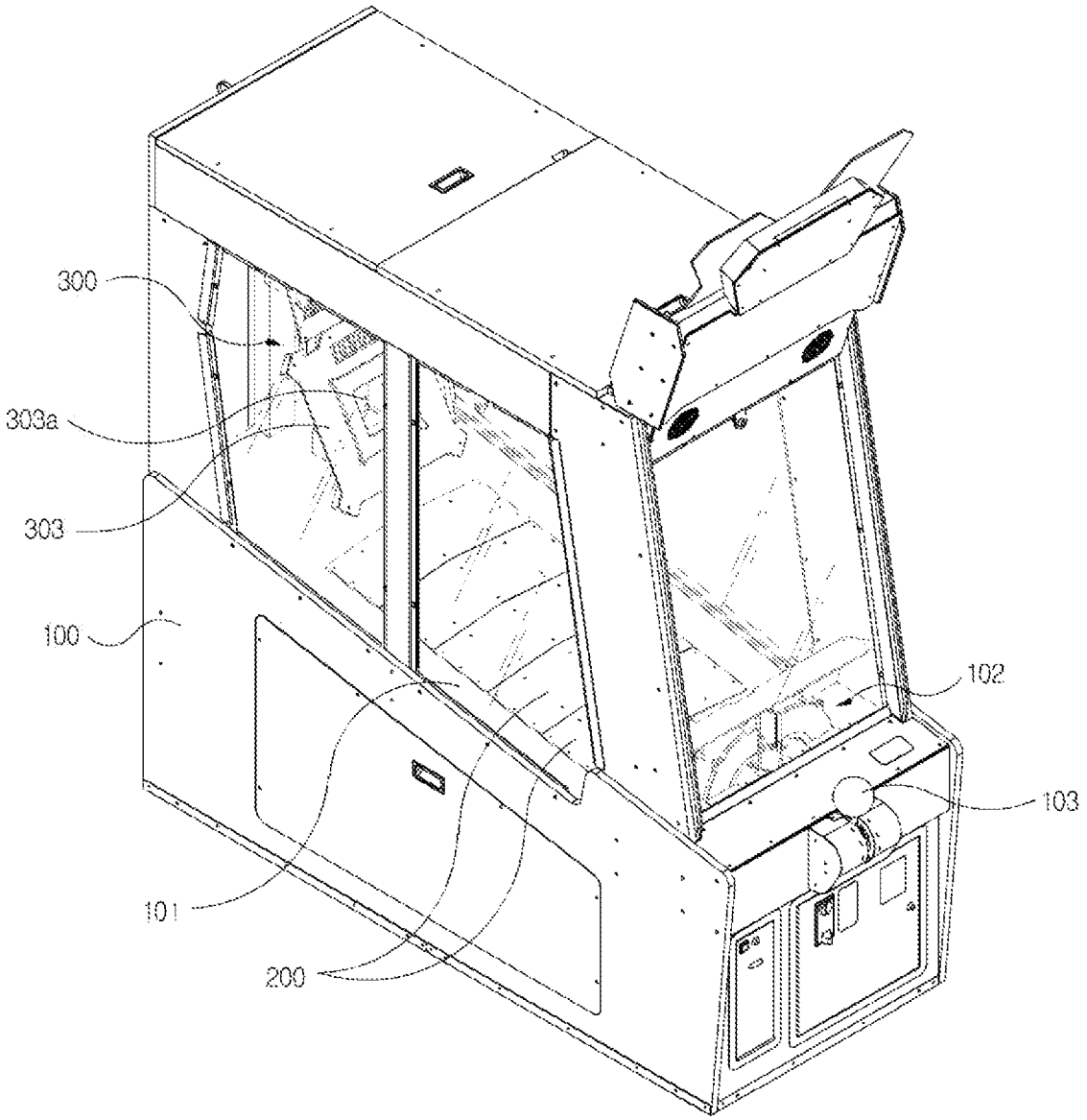
FIG. 1 is a perspective view illustrating a ball throwing game machine according to the present disclosure.
Figure 2:
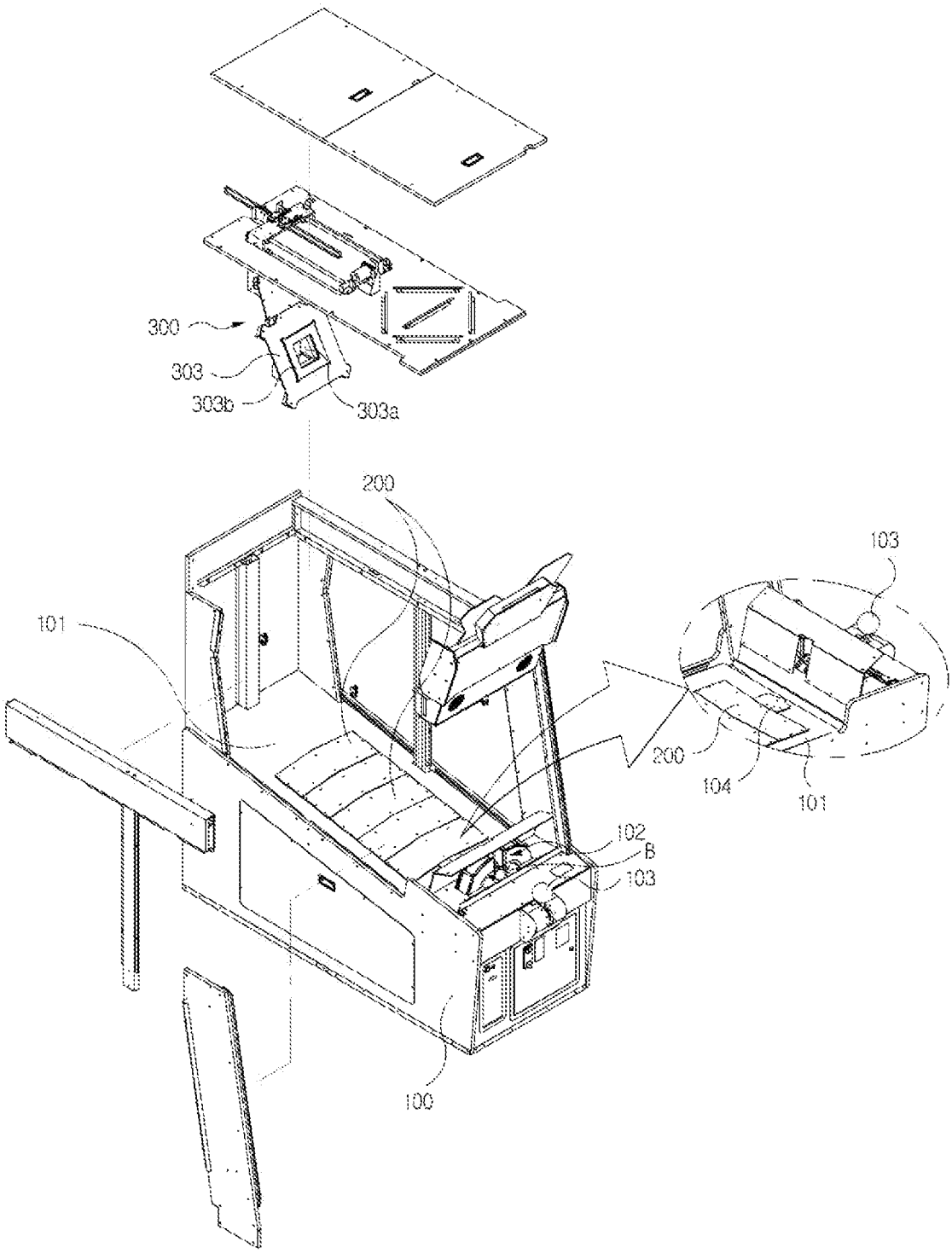
FIG. 2 is an exploded perspective view of a portion of FIG. 1.
Figure 3:
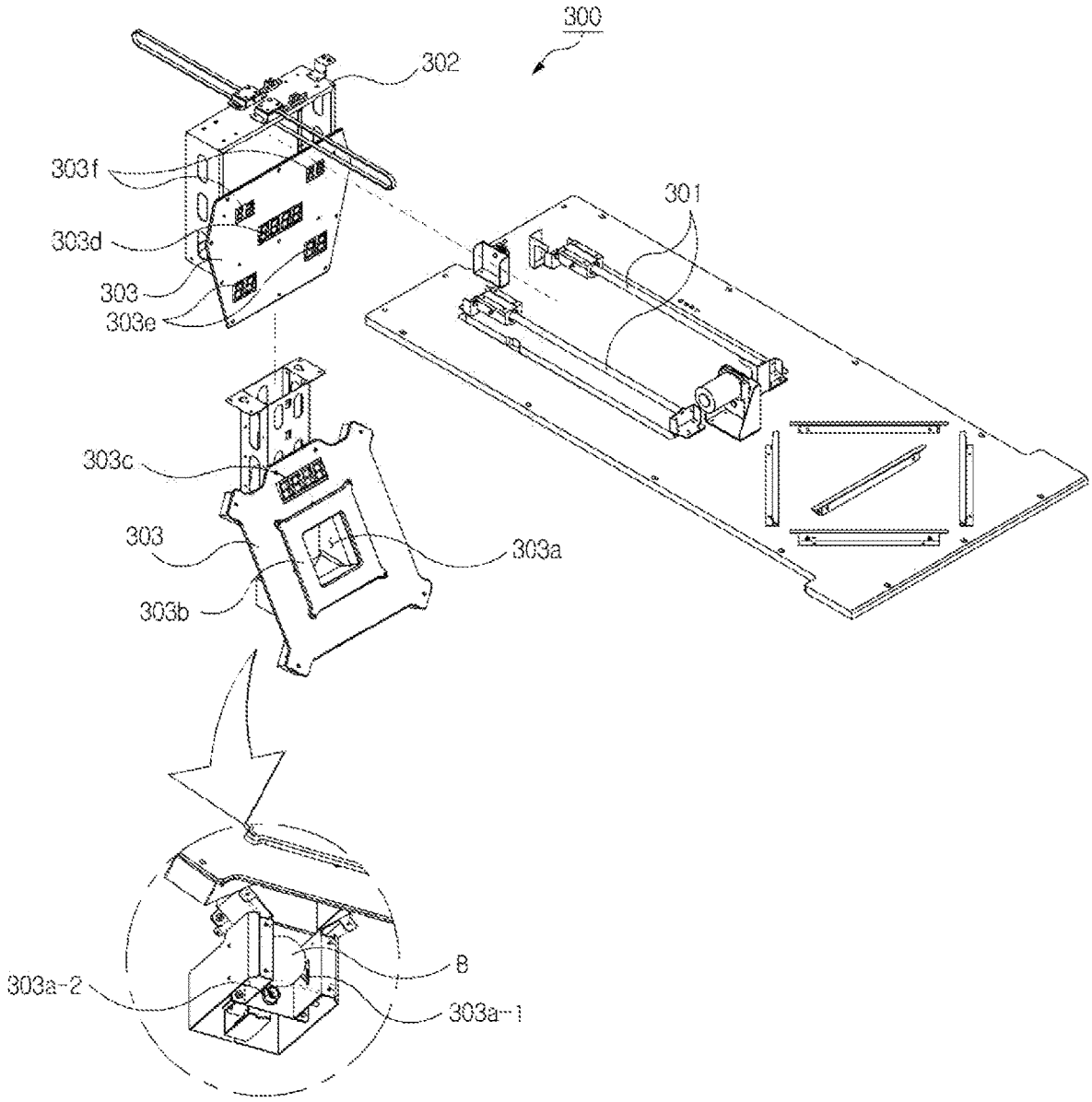
FIG. 3 is an exploded perspective view of a game operation part of the ball throwing game machine according to the present disclosure.
Figure 4:
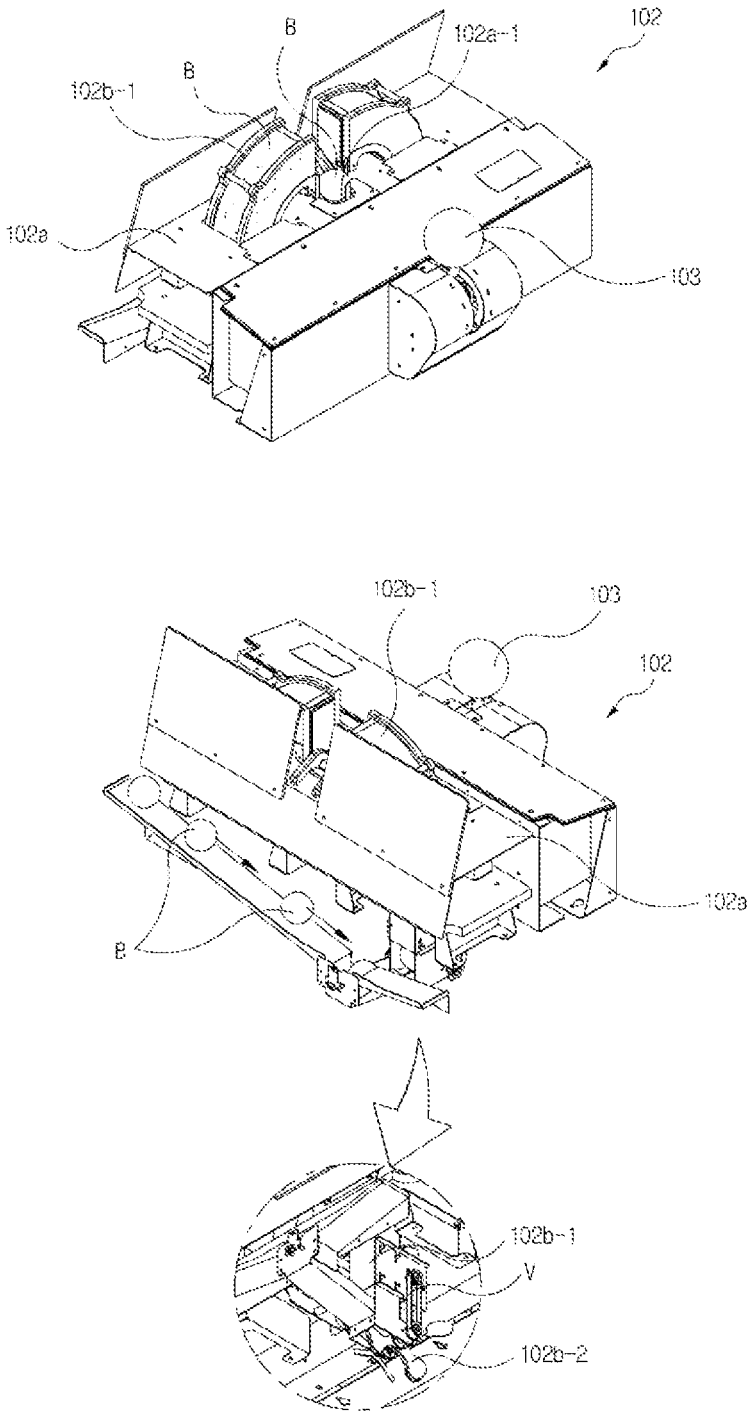
FIG. 4 is a perspective view illustrating a hitting device of the ball throwing game machine according to the present disclosure.
Figure 5:
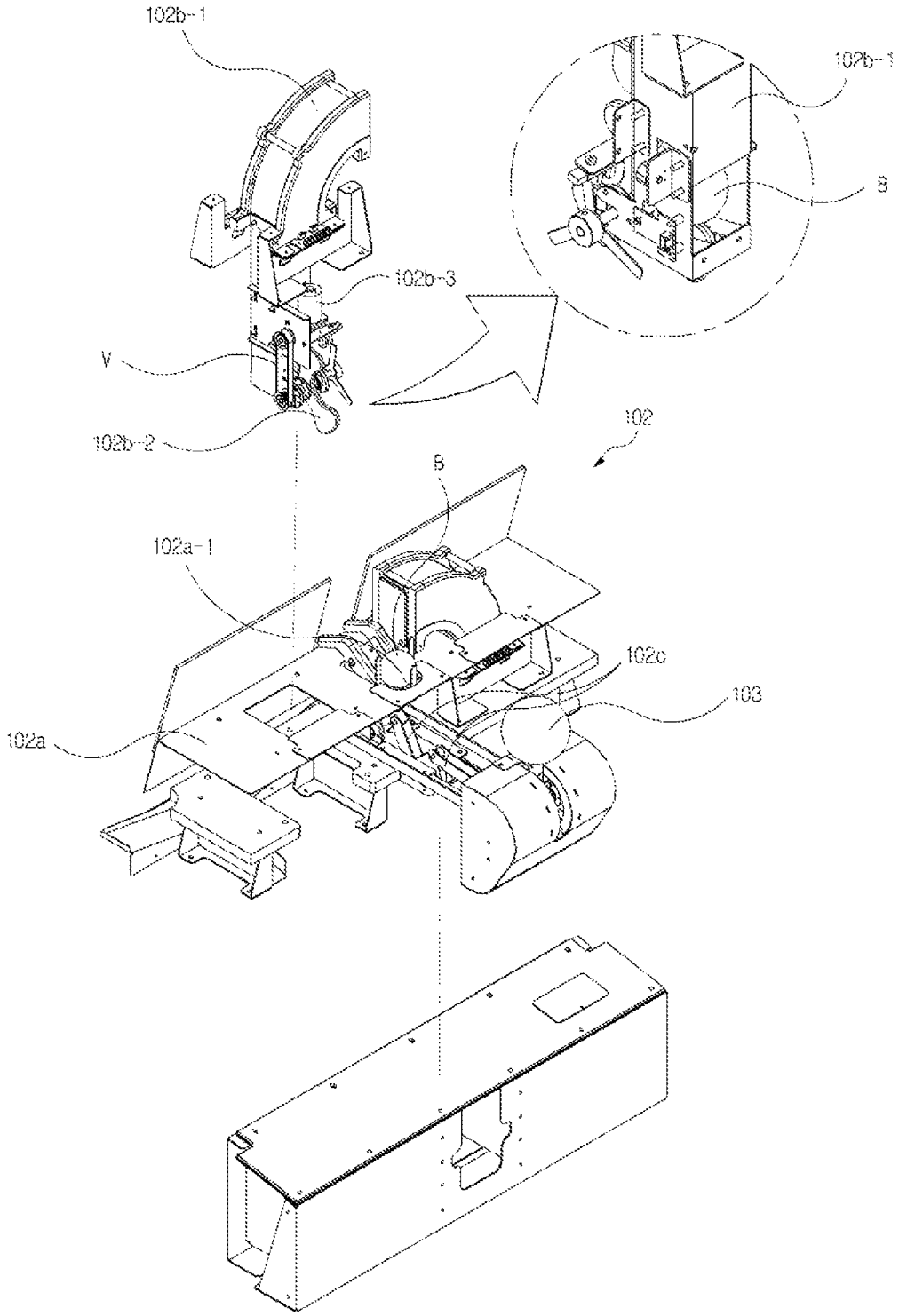
FIG. 5 is an exploded perspective view of the hitting device of the ball throwing game machine according to the present disclosure.

Referring to FIGS. 1 to 5, a main body 100 includes an inclined plate 101 formed on a bottom surface to be inclined downward from a rear end toward a front end, a hitting device 102 formed on the front end to receive a ball B sliding downward along the inclined plate 101 and configured to hit the ball B so that the ball B is thrown to fly in the air toward the inclined plate 101, and a handle 103 formed on a front surface and connected to the hitting device 102 to control a hitting force of the hitting device 102.

The main body 100 includes a coin input slot (not denoted by a reference numeral) and a ticket output slot (not denoted by a reference numeral) formed therein.

The ticket output slot (not denoted by a reference numeral) allows one or more tickets to be output corresponding to a total score obtained by throwing the ball B.

The front end and both side surfaces of the main body 100 are surrounded by acrylic or glass to prevent a ball flying in the air from falling to the outside.

The inclined plate 101 guides a ball B which falls after colliding with a front surface of a game operation part 300 or a ball which falls to a lower portion of the game operation part 300 after entering the game operation part 300 to move toward the hitting device 102.

The inclined plate 101 may be formed to be inclined at a predetermined angle.

As the hitting device 102 is forcibly moved rearward by the handle 103 and then restored to its original position, the ball B is hit by the hitting device 102.

By hitting the ball B, the hitting device 102 allows the ball B to reach the game operation part 300 in a parabolic trajectory.

The hitting device 102 includes a base plate 102*a* which has a plate shape and is formed so that an upper surface thereof is recessed to form a seating hole 102*a*-1 that allows the ball B to be seated, a ball entry device 102*b* which is installed to be fixed to an upper surface of the base plate 102*a* and is configured to move the ball B, which has slid downward along the inclined plate 101, upward to guide the ball B to fall into the seating hole 102*a*-1, and a hitting link 102*c* which has one end connected to the handle 103 and the other end rotatably installed on the base plate 102*a* to hit the ball B seated in the seating hole 102*a*-1.

The base plate 102*a* has the seating hole 102*a*-1 formed in a central portion so that the ball B is seated on the central portion of the base plate 102*a*.

The base plate 102*a* allows the ball entry device 102*b* to be exposed through an upper portion.

The ball entry device 102*b* forces upward movement of the ball B to cause the ball B to fall and be supplied into the seating hole 102*a*-1.

The ball entry device 102*b* includes a ball guide part 102*b*-1 which has a hollow shape, has an upper end formed to be bent toward the seating hole 102*a*-1 of the base plate 102*a* and a lower end formed to stand upright, and is configured to guide the upward movement of the ball B, which has slid downward along the inclined plate 101, to guide the ball B to fall into the seating hole 102*a*-1, a blade 102*b*-2 which is installed on the lower end of the ball guide part 102*b*-1 and is configured to rotate in-situ and press the ball, which is positioned on the lower end of the ball guide part 102*b*-1, upward so that the ball B moves upward along the ball guide part 102*b*-1, and a driving motor 102*b*-3 which is positioned directly above the blade 102*b*-2, is installed to be fixed to an inner wall surface of the main body 100, and is connected to the blade 102*b*-2 via a belt V to transmit rotation power to the blade 102*b*-2 through the belt V.

The ball guide part 102*b*-1 allows the ball B to move into an inner space thereof to guide the ball B to move from the lower end toward the upper end.

The ball guide part 102*b*-1 may be formed of a transparent material to allow a movement state of the ball B moving in the inner space to be checked by visual inspection.

While rotating in-situ, the blade 102*b*-2 allows the ball B to move into an outer surface thereof and causes the ball B to continuously move into the ball guide part 102*b*-1 to force upward movement of the ball B along the ball guide part 102*b*-1.

The blade 102*b*-2 receives rotation power from the driving motor 102*b*-3 and rotates in-situ to allow the ball B to move into the ball guide part 102*b*-1.

The driving motor 102*b*-3 is connected to the blade 102*b*-2 via the belt V and rotates in-situ to circulate the belt V.

The hitting link 102*c* is moved rearward by the handle 103 and, due to the handle 103 returning to its original position, moves into the seating hole 102*a*-1 and hits the ball B seated in the seating hole 102*a*-1.

A hitting force of the hitting link 102*c* hitting the ball B is adjusted in proportion to a distance at which the hitting link 102*c* is moved rearward.

The hitting link 102*c* may be formed of a two-stage joint structure and move rearward or forward.

The handle 103 is forcibly moved rearward while held by a user and thus causes the hitting device 102 to move rearward.

The handle 103 is formed to return to its original position due to an elastic force and thus causes the hitting device 102 to hit the ball B.

The main body 100 further includes a missed-ball score display window 104 formed between score display devices 200 and the hitting device 102 to display a predetermined score that corresponds to the number of balls that collide with an edge of the game operation part 300, then slide downward along the inclined plate 101 and are supplied to the hitting device 102.

The missed-ball score display window 104 may provide a score that is relatively lower than a score of balls B that have entered the game operation part 300.

The missed-ball score display window 104 may not be operated in a case in which the ball B enters the game operation part 300.

The score display devices 200 are formed on an upper surface of the inclined plate 101 in a longitudinal direction thereof and are formed to be partitioned and spaced at a predetermined interval from each other and have different colors.

The score display devices 200 display a score at the time the ball B enters the game operation part 300.

The score display devices 200 display predetermined scores different from each other according to the colors thereof.

The score display devices 200 are controlled by a control device 400 and display the scores.

The game operation part 300 is positioned on an upper portion of the inclined plate 101 and installed to slide on an upper surface of an inner side of the main body 100 and is configured to slide back and forth and be changed with a time difference to emit light of a color corresponding to any one of the plurality of score display devices 200 to allow the ball B flying in the air to enter.

The game operation part 300 is controlled by the control device 400 and moves back and forth to have a predetermined pattern.

The game operation part 300 may gradually move back and forth with a time difference using a multi-stage method, a sliding method, or by repeating back and forth movement within a predetermined movement distance.

In order to have a predetermined pattern, the game operation part 300 is changed to emit light of a color corresponding to any one of the score display devices 200.

The game operation part 300 includes a guide rail 301 which is formed on the upper surface of the main body 100 in the longitudinal direction thereof, a sliding operation part 302 which is coupled to slide on the guide rail 301 and has a lower end moving into the main body 100 and positioned on the upper portion of the inclined plate 101, and a game board 303 which is installed to be fixed to a lower end of the sliding operation part 302 and has a ball entry hole 303*a*, which allows entry of the ball B, formed in a central portion and a light emitting part 303*b* formed on an edge of the ball entry hole 303*a*.

The guide rail 301 is formed as a pair of guide rails 301 symmetrical to each other, and the pair of guide rails 301 guide sliding of the sliding operation part 302.

The sliding operation part 302 is connected to the control device 400, receives a signal from the control device 400, and slides back and forth.

The game board 303 is formed to be inclined at a predetermined angle and allows a ball to enter the ball entry hole 303*a*.

The ball entry hole 303*a* includes a push switch 303*a*-1 which is formed on an inner wall surface and is pressed by the ball B entering the ball entry hole 303*a* to detect whether the ball B has entered and a ball support part 303*a*-2 which is installed to horizontally move on the inner wall surface, has an end positioned in the ball entry hole 303*a* to support the ball B entering the ball entry hole 303*a*, and is configured to receive a signal from the push switch 303*a*-1 and horizontally move to guide the ball B in the ball entry hole 303*a* to fall and be discharged downward.

The push switch 303*a*-1 is pressed by an outer surface of the ball B and outputs a signal, which indicates whether the ball B has entered, to the control device 400.

The ball support part 303*a*-2 is horizontally moved using a solenoid, a hydraulic pressure, a pneumatic pressure, or a ball screw and guides the ball B in the ball entry hole 303*a* to fall downward.

As the signal from the push switch 303*a*-1 is transmitted to the control device 400, the ball support part 303*a*-2 receives a signal from the control device 400 and horizontally moves so that the ball B falls downward.

The light emitting part 303*b* may have a light emitting diode (LED) mounted therein and be changed with a time difference to emit light of a color corresponding to any one of the score display devices 200.

The light emitting part 303*b* may be formed in any one of a circular shape, a semicircular shape, and a polygonal shape along the edge of the ball entry hole 303*a*.

The game board 303 further includes a score display window 303*c* which is formed on a front surface and configured to display a sum of scores input to the plurality of score display devices 200, a bonus score display window 303*d* which is formed on an upper end of the score display window 303*c* and configured to display a bonus score, a plurality of number display windows 303*e* which are partitioned from each other and configured to display the number of remaining balls B available for hitting and the number of balls B that have entered the ball entry hole 303*a*, and a notification window 303*f* which is configured to display the number of balls B provided upon a start of a game and the number of balls B that should enter the ball entry hole 303*a* to begin a bonus mode to obtain the bonus score input to the bonus score display window 303*d*.

The score display window 303*c* adds up a plurality of scores input to the score display devices 200 and displays a total score input to the score display devices 200.

When scores are input to the score display devices 200, the score display window 303*c* adds up the scores input to the score display devices 200 and displays a total score in real time.

The bonus score display window 303*d* displays a bonus score that can be obtained in the bonus mode.

While a game is played, the number display windows 303*e* guide a game player to check, by visual inspection, the number of remaining balls B and the number of balls B that have entered the ball entry hole 303*a*.

The notification window 303*f* continuously notifies the game player of the number of balls B provided while a game is played or not played and the number of balls B that should enter the ball entry hole 303*a* for the bonus mode to begin.

The control device 400 is installed on the inner side of the main body 100, controls the sliding movement of the game operation part 300, and simultaneously receives a ball B entry signal and a light emission color signal, at the time the ball B enters, from the game operation part 300 to output a signal to the score display device 200 corresponding to the color of light emitted from the game operation part 300 and input a score to the score display device 200 corresponding to the color of light emitted from the game operation part 300.

The control device 400 analyzes the light emission color signal of the game operation part 300 and, according to colors of emitted light, inputs different scores to the score display device 200 corresponding to the color of emitted light.

The control device 400 may calculate a total score and output the number of tickets that corresponds to the total score.

The control device 400 slides the sliding operation part 302 of the game operation part 300 in a predetermined pattern.

The control device 400 controls light emission so that a color of the light emitting part 303*b* of the game operation part 300 changes with a time difference to a color corresponding to a color of any one of the score display devices 200.

The ball throwing game machine according to the present disclosure that is configured as above is used as follows.

In the following description, a case in which scores of the balls B that have entered the game operation part 300 are added up, and tickets corresponding to the added-up score are output through the ticket output slot (not denoted by a reference numeral) formed in the front surface of the main body 100 will be described as an example.

First, a coin is input to the coin input slot (not denoted by a reference numeral) formed in the front surface of the main body 100 so that a ball enters the hitting device 102 of the main body 100.

Here, when a coin is input to the coin input slot (not denoted by a reference numeral) of the main body 100, the driving motor 102*b*-3 formed on the ball entry device 102*b* of the hitting device 102 rotates to cause the blade 102*b*-2 to rotate in-situ, and accordingly, a ball B that has moved toward an outer surface of the blade 102*b*-2 is pressed upward by the blade 102*b*-2 and moves toward a lower end of the ball guide part 102*b*-1.

Also, as the blade 102*b*-2 consecutively supplies balls B into the ball guide part 102*b*-1, the ball B is moved upward by another ball B moving into the ball guide part 102*b*-1 and is seated on the seating hole 102*a*-1 of the base plate 102*a*.

Here, the blade 102*b*-2 is connected to the driving motor 102*b*-3 via the belt V, and as the driving motor 102*b*-3 rotates, rotation power is transmitted to the blade 102*b*-2 through the belt V, and the blade 102*b*-2 rotates in-situ.

Then, when the handle 103 of the main body 100 is held and, in that state, the handle 103 is pulled and moved rearward, the hitting link 102*c* connected to the handle 103 maintains a state in which it is moved rearward.

Here, the game operation part 300 slides back and forth while being changed with a time difference to emit light of a color corresponding to any one of the score display devices 200 in the main body 100.

That is, the sliding operation part 302 of the game operation part 300 receives a signal from the control device 400, slides back and forth along the guide rails 301, and guides the game board 303 to move back and forth, and in this way, the position of the game board 303 changes in real time.

Then, when a force pulling the handle 103 is released, the handle 103 simultaneously returns to its original position due to an elastic force and causes the hitting link 102*c* to move forward, and here, as the hitting link 102*c* moves into the seating hole 102*a*-1 of the base plate 102*a*, the hitting link 102*c* hits the outer surface of the ball B seated on the seating hole 102*a*-1, and the ball B is thrown to fly toward the game operation part 300.

Then, the ball B flies toward the game operation part 300 in a parabolic trajectory and then enters the ball entry hole 303*a* formed in the game board 303 of the game operation part 300, and here, as the ball B that has entered the ball entry hole 303*a* presses the push switch 303*a*-1 simultaneously as the ball B is seated on the ball support part 303*a*-2, the control device 400 receives a signal from the push switch 303*a*-1 and checks whether the ball B has entered.

Here, the control device 400 receives a light emission color signal from the light emitting part 303*b* simultaneously as the push switch 303*a*-1 is pressed, and inputs a predetermined score to the score display device 200 corresponding to the color of light emitted by the light emitting part 303*b* so that a score is input to the score display device 200 corresponding to the color of light emitted by the light emitting part 303*b* among the plurality of score display devices 200.

Here, scores input to each of the plurality of score display devices 200 are input in an added-up state to the score display window 303*c* of the game board 303 so that a game player checks a total score through the score display window 303*c*.

Also, when a score is input to the score display window 303*c*, the control device 400 operates the ball support part 303*a*-2 and causes the ball support part 303*a*-2 to move rearward in the horizontal direction, and thus the ball B supported by the ball support part 303*a*-2 falls downward.

Next, the ball B fallen to a lower portion of the game board 303 is guided by the inclined plate 101 and slides toward the hitting device 102 of the main body 100 and then is moved upward through the ball entry device 102*b* by the same method as above so that balls B are consecutively supplied to the seating hole 102*a*-1 of the base plate 102*a*.

Also, the handle 103 is moved rearward to consecutively hit the balls B by the hitting link 102*c* of the hitting device 102 and cause the balls B to enter the ball entry hole 303*a* of the game operation part 300.

Meanwhile, when a predetermined number of balls B consecutively enters the ball entry hole 303*a* of the game operation part 300, a mode is switched to a bonus mode in which a bonus score input to the bonus score display window 303*d* of the game board 303 can be obtained, and here, in a case in which the ball B is thrown to the game operation part 300 and the ball B enters the ball entry hole 303*a*, the bonus score input to the bonus score display window 303*d* is obtained.

On the other hand, in a state in which the mode is switched to the bonus mode, when a predetermined number of balls B is thrown and the balls fail to enter the ball entry hole 303*a*, the bonus mode is automatically ended.

Then, among the balls hit by the hitting device 102 and thrown toward the game board 303 of the game operation part 300, balls that collide with a front surface of the game board 303 and then fall to the inclined plate 101 move toward the hitting device 102 due to the inclined plate 101, and here, a score corresponding to the balls B moving toward the hitting device 102 is input to the missed-ball score display window 104.

Here, in the state in which the mode is switched to the bonus mode, a score of the balls B that collide with the front surface of the game board 303 of the game operation part 300, then fall to the inclined plate 101 and are supplied to the hitting device 102 is prevented from being input to the missed-ball score display window 104.

Also, balls B are consecutively hit by the same method as above, scores input to each of the score display devices 200 are added up through the score display window 303*c*, the added-up score of the score display window 303*c* is calculated by the control device 400, and as many tickets as the number corresponding to the score input to the score display window 303*c* are output through the ticket output slot (not denoted by a reference numeral) of the main body 100.

As described above, in a structure in which a ball B enters the game operation part 300, which changes with a time difference to emit light of a color corresponding to any one of the score display devices 200, and a score is input to the score display device 200 corresponding to the color of light emitted by the game operation part 300, a color of light emitted by the game operation part 300 changes in succession with a time difference, thus allowing a user to, with a time difference, throw a ball when light of a designated color is emitted or selectively throw a ball when beams of light of various colors are emitted, different scores are provided according to colors of light emitted by the game operation part 300, thus causing interest in the game, and in particular, while the color of the light emitted by the game operation part 300 changes, the game operation part 300 slides back and forth, and a user attempts to throw a ball B into the game operation part 300, and in this way, a distance between a position at which the ball B is thrown and the game operation part 300 changes frequently, and the user can directly select a level of difficulty of throwing the ball B.

According to the present disclosure, a color of light emitted by a game operation part changes in succession with a time difference to allow a user to, with a time difference, throw a ball when light of a designated color is emitted or selectively throw a ball when beams of light of various colors are emitted, and different scores are provided according to the color of light emitted by the game operation part to cause interest in the game. In particular, while the color of the light emitted by the game operation part changes, the game operation part slides back and forth, and a user attempts to throw a ball into the game operation part, and in this way, a distance between a ball throw position and the game operation part changes frequently, and the user can directly select a level of difficulty of ball throwing. A hitting force of a hitting device can be easily controlled using a handle of a main body, and thus users with low muscular strength, such as the elderly or children, can easily use the ball throwing game machine. Also, through a score display device, a user can check, by visual inspection, a score provided when a ball enters the game operation part and thus can easily check the score in real time, which motivates the user to try obtaining a desired score. In this way, there is an advantage that reliability of the ball throwing game machine is improved.

The ball throwing game machine according to the present disclosure that has been described above is not limited to the embodiments described above, various modifications may be made by those of ordinary skill in the art to which the present disclosure pertains without departing from the gist of the present disclosure claimed in the claims below, and such modifications also belong to the technical spirit of the present disclosure.

What is claimed is:

1. A ball throwing game machine comprising:

a main body (100) having an inclined plate (101) formed on a bottom surface to be inclined downward from a rear end toward a front end, a hitting device (102) formed on the front end to receive a ball (B) sliding downward along the inclined plate (101) and configured to hit the ball (B) so that the ball (B) is thrown to fly in air toward the inclined plate (101), and a handle (103) formed on a front surface and connected to the hitting device (102) to control a hitting force of the hitting device (102);

a plurality of score display devices (200) formed on an upper surface of the inclined plate (101) in a longitudinal direction thereof and formed to be partitioned and spaced at a predetermined interval from each other and have different colors;

a game operation part (300) positioned on an upper portion of the inclined plate (101) and installed to slide on an upper surface of an inner side of the main body (100) and configured to slide back and forth and be changed with a time difference to emit light of a color corresponding to any one of the plurality of score display devices (200) to allow the ball flying in the air to enter; and a control device (400) installed on the inner side of the main body (100) and configured to control sliding movement of the game operation part (300) and simultaneously receive a ball (B) entry signal and a light emission color signal, at the time the ball (B) enters, from the game operation part (300) to output a signal to the score display device (200) corresponding to the color of light emitted from the game operation part (300) and input a score to the score display device (200) corresponding to the color of light emitted from the game operation part (300).

2. The ball throwing game machine of claim 1, wherein the main body (100) is formed so that the handle (103) returns to its original position due to an elastic force, and the hitting device (102) includes:

a base plate (102*a*) which has a plate shape and is formed so that an upper surface thereof is recessed to form a seating hole (102*a*-1) that allows the ball (B) to be seated;

a ball entry device (102*b*) which is installed to be fixed to an upper surface of the base plate (102*a*) and is configured to move the ball (B), which has slid downward along the inclined plate (101), upward to guide the ball (B) to fall into the seating hole (102*a*-1); and a hitting link (102*c*) which has one end connected to the handle (103) and the other end rotatably installed on the base plate (102*a*) to hit the ball (B) seated in the seating hole (102*a*-1).

3. The ball throwing game machine of claim 2, wherein the ball entry device (102*b*) includes:

a ball guide part (102*b*-1) which has a hollow shape, has an upper end formed to be bent toward the seating hole (102*a*-1) of the base plate (102*a*) and a lower end formed to stand upright, and is configured to guide upward movement of the ball (B), which has slid downward along the inclined plate (101), to guide the ball (B) to fall into the seating hole (102*a*-1);

a blade (102*b*-2) which is installed on a lower end of the ball guide part (102*b*-1) and is configured to rotate in-situ and press the ball, which is positioned on the lower end of the ball guide part (102*b*-1), upward so that the ball moves upward along the ball guide part (102*b*-1); and a driving motor (102*b*-3) which is positioned directly above the blade (102*b*-2), is installed to be fixed to an inner wall surface of the main body (100), and is connected to the blade (102*b*-2) via a belt (V) to transmit rotation power to the blade (102*b*-2) through the belt (V).

4. The ball throwing game machine of claim 1, wherein the main body (100) further includes a missed-ball score display window (104) formed between the score display devices (200) and the hitting device (102) to display a score that corresponds to the number of balls that collide with an edge of the game operation part (300), then slide downward along the inclined plate (101) and are supplied to the hitting device (102).

5. The ball throwing game machine of claim 1, wherein the game operation part (300) includes:

a guide rail (301) which is formed on the upper surface of the main body (100) in the longitudinal direction thereof;

a sliding operation part (302) which is coupled to slide on the guide rail (301) and has a lower end moving into the main body (100) and positioned on the upper portion of the inclined plate (101); and a game board (303) which is installed to be fixed to a lower end of the sliding operation part (302) and has a ball entry hole (303*a*), which allows entry of the ball (B), formed in a central portion and a light emitting part (303*b*) formed on an edge of the ball entry hole (303*a*).

6. The ball throwing game machine of claim 5, wherein the ball entry hole (303*a*) includes:

a push switch (303*a*-1) which is formed on an inner wall surface and is pressed by a ball (B) entering the ball entry hole (303*a*) to detect whether the ball (B) has entered; and a ball support part (303*a*-2) which is installed to horizontally move on the inner wall surface, has an end positioned in the ball entry hole (303*a*) to support the ball (B) entering the ball entry hole (303*a*), and is configured to receive a signal from the push switch (303*a*-1) and horizontally move to guide the ball (B) in the ball entry hole (303*a*) to fall and be discharged downward.

7. The ball throwing game machine of claim 5, wherein the game board (303) further includes:

a score display window (303*c*) which is formed on a front surface and configured to display a sum of scores input to the plurality of score display devices (200);

a bonus score display window (303*d*) which is formed on an upper end of the score display window (303*c*) and configured to display a bonus score;

a plurality of number display windows (303*e*) which are partitioned from each other and configured to display the number of remaining balls (B) available for hitting and the number of balls (B) that have entered the ball entry hole (303*a*); and a notification window (303*f*) which is configured to display the number of balls (B) provided upon a start of a game and the number of balls (B) that should enter the ball entry hole (303*a*) for a bonus mode to begin to obtain the bonus score input to the bonus score display window (303*d*).

* * * * *